US010987935B1

(12) United States Patent
Dryer et al.

(10) Patent No.: US 10,987,935 B1
(45) Date of Patent: Apr. 27, 2021

(54) ORGANIC SOLVENT SEALING TAPE

(71) Applicant: FUNAI ELECTRIC CO., LTD., Osaka (JP)

(72) Inventors: Paul W. Dryer, Lexington, KY (US); David C. Graham, Lexington, KY (US); Sean T. Weaver, Lexington, KY (US)

(73) Assignee: FUNAI ELECTRIC CO. LTD

( * ) Notice: Subject to any disclaimer, the term of this patent is extended or adjusted under 35 U.S.C. 154(b) by 0 days.

(21) Appl. No.: 16/741,812

(22) Filed: Jan. 14, 2020

(51) Int. Cl.
*B41J 2/175* (2006.01)

(52) U.S. Cl.
CPC ..... *B41J 2/17536* (2013.01); *B41J 2/1754* (2013.01); *B41J 2/17559* (2013.01)

(58) Field of Classification Search
CPC ... B41J 2/17536; B41J 2/1754; B41J 2/17559
See application file for complete search history.

(56) References Cited

U.S. PATENT DOCUMENTS 5,781,208 A 7/1998 Karita et al.
7,540,584 B2 6/2009 Bertelsen et al.
2009/0155596 A1 6/2009 Kropp et al.
2012/0098885 A1* 4/2012 Harada ..... B41J 2/17536 347/29
2018/0111381 A1 4/2018 Komplin

FOREIGN PATENT DOCUMENTS

JP 3334899 B2 * 10/2002

* cited by examiner

*Primary Examiner* — Matthew Luu
*Assistant Examiner* — Kendrick X Liu
(74) *Attorney, Agent, or Firm* — Luedeka Neely Group, PC

(57) ABSTRACT

A fluidic ejection cartridge and protective tape therefor. The fluidic ejection cartridge has a cartridge body for an organic solvent-based fluid having a cover closing a first end thereof, an ejection head on a second end thereof opposite the first end, and side walls attached to the first and second ends between the first and second ends, wherein the side walls comprise a first side wall, a second side wall opposite the first side wall, a first end wall attached to the first and second side walls, and a second end wall opposite the first end wall attached to the first and second side walls. A removable tape is attached to a nozzle plate of the ejection head and to a portion of the first side wall, wherein the removable tape comprises a polymeric backing film and a platinum-cured silicone adhesive.

13 Claims, 5 Drawing Sheets

ORGANIC SOLVENT SEALING TAPE

TECHNICAL FIELD

This disclosure relates to the field of fluidic ejection cartridges. More particularly, this disclosure relates to an improved sealing tape for use on fluidic ejection cartridges that contain organic solvents.

BACKGROUND

Fluidic ejection cartridges may be used in variety of applications, including for instance inkjet printing applications, medicinal fluid delivery applications, and vapor delivery applications. The amount of time such cartridges remain in transit from the manufacture and/or in storage (prior to installation and use) may constitute a large portion of the lifecycle of the cartridge. In some instances, the shipping and storage time may even constitute the majority of the lifecycle of the cartridge. Consequently, it is important that the operability of the cartridge not degrade during storage, even if the cartridge remains in storage for an extended period of time.

During shipping and storage of the fluidic ejection cartridges, a protective tape is used to cover the ejection head and ejection nozzles on the ejection head. The protective tape prevents contamination of the ejection head, prevents seepage of fluid from the ejection head, and reduces the amount of solvent evaporated from the fluid in the cartridge during shipping and storage of the cartridge. Prior to use, the protective tape is removed from the fluidic ejection cartridge to expose the ejection nozzles.

Conventional pressure sensitive adhesive (PSA) sealing tapes that are used to seal the nozzle holes in an ejection head are typically an acrylic type adhesive with a polyvinyl chloride or polyethylene terephthalate backing film. However, when the fluidic cartridge contains an organic solvent rather than an aqueous-based fluid, the acrylic adhesives in conventional protective tapes may be solubilized by the organic solvent causing fluid leaking from the cartridge and/or premature peeling of the tape from the ejection head.

In order to assure that the protective tape does not prematurely peel off of the ejection head, a suitable tape and adhesive system must be found that will not be readily solubilized by the organic solvents present in the fluidic cartridge, and that provides a protective tape having a suitable peel strength. Accordingly, what is needed is a pressure sensitive adhesive tape sealing system that can be used with fluidic cartridges that contain organic solvents rather than aqueous-based fluids.

SUMMARY

With regard to the foregoing, an embodiment of the disclosure provides a fluidic ejection cartridge and protective tape therefor. The fluidic ejection cartridge has a cartridge body for an organic solvent-based fluid having a cover closing a first end thereof, an ejection head on a second end thereof opposite the first end, and side walls attached to the first and second ends between the first and second ends, wherein the side walls comprise a first side wall, a second side wall opposite the first side wall, a first end wall attached to the first and second side walls, and a second end wall opposite the first end wall attached to the first and second side walls. A removable tape is attached to a nozzle plate of the ejection head and to a portion of the first side wall, wherein the removable tape comprises a polymeric backing film and a platinum-cured silicone adhesive.

In another aspect, the disclosure provides a method for improving the sealing of a nozzle plate of an ejection head attached to a fluidic ejection cartridge containing an organic solvent-based fluid. The method includes providing a cartridge body for the organic solvent-based fluid having a cover closing a first end thereof, the ejection head on a second end thereof opposite the first end, and side walls attached to the first and second ends between the first and second ends, wherein the side walls comprise a first side wall, a second side wall opposite the first side wall, a first end wall attached to the first and second side walls, and a second end wall opposite the first end wall attached to the first and second side walls. A removable tape is attached to the nozzle plate of the ejection head and to a portion of the first side wall, wherein the removable tape comprises a polymeric backing film and a platinum-cured silicone adhesive.

In a further aspect, the disclosure provides a removable tape having a peel strength on a dry silicon wafer ranging from about 175 to about 350 N/m. In some embodiments, the removable tape has a peel strength on a silicon wafer immersed in an organic solvent for three days ranging from about 17 to about 70 N/m. In other embodiments, the platinum-cured silicone adhesive has a thickness on the polymeric backing film ranging from about 20 to about 70 microns. In some embodiments, the removable tape includes a platinum-cured silicone adhesive material applied to a polymeric backing film wherein the polymer of the backing film is selected from polyethylene terephthalate, polypropylene, polyamide and polyimide.

In some embodiments, the removable tape is disposed on the nozzle plate so as to prevent the organic solvent-based fluid from leaking out of the ejection head.

In still other embodiments, there is provided a fluidic ejection device that contains a fluidic ejection cartridge for an organic solvent-based fluid wherein a nozzle plate on an ejection head of the fluidic ejection cartridge is covered with a removable tape that contains a polymeric backing film and a platinum-cured silicone adhesive.

A particular advantage of the embodiments of the disclosure is that the removable tape is effective to cover and seal the nozzle plate of an ejection head for a fluidic cartridge containing an organic solvent-based fluid for an extended period of time during shipping and storage of the fluidic cartridge.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
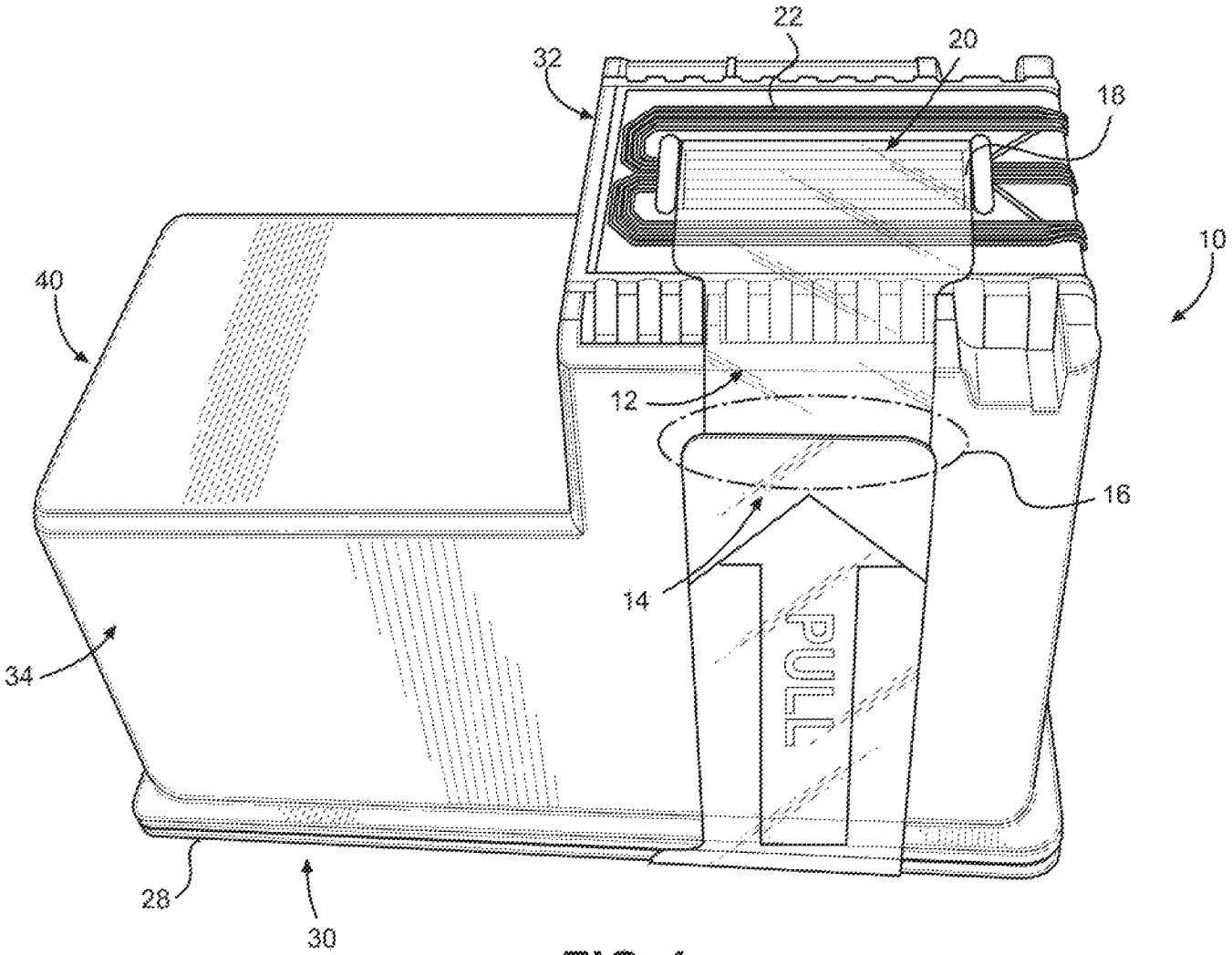
FIG. 1 is a side perspective view of a fluidic ejection cartridge according to an embodiment of the disclosure.

With reference to FIG. 1, there is shown a fluidic cartridge 10 containing a protective sealing tape 12 and a pull tape 14 overlapping a portion 16 of the protective sealing tape 12. The protective sealing tape 12 is used to cover a nozzle plate 18 of an ejection head 20 attached to the fluidic cartridge 10. The protective sealing tape 12 prevents contamination and damage to the ejection head 20, seals nozzle holes in the nozzle plate 18 so that fluid in the fluidic cartridge 10 does not lead out or dry out and plug the nozzle holes during shipping and storage of the fluidic cartridge 10.

Figure 2:
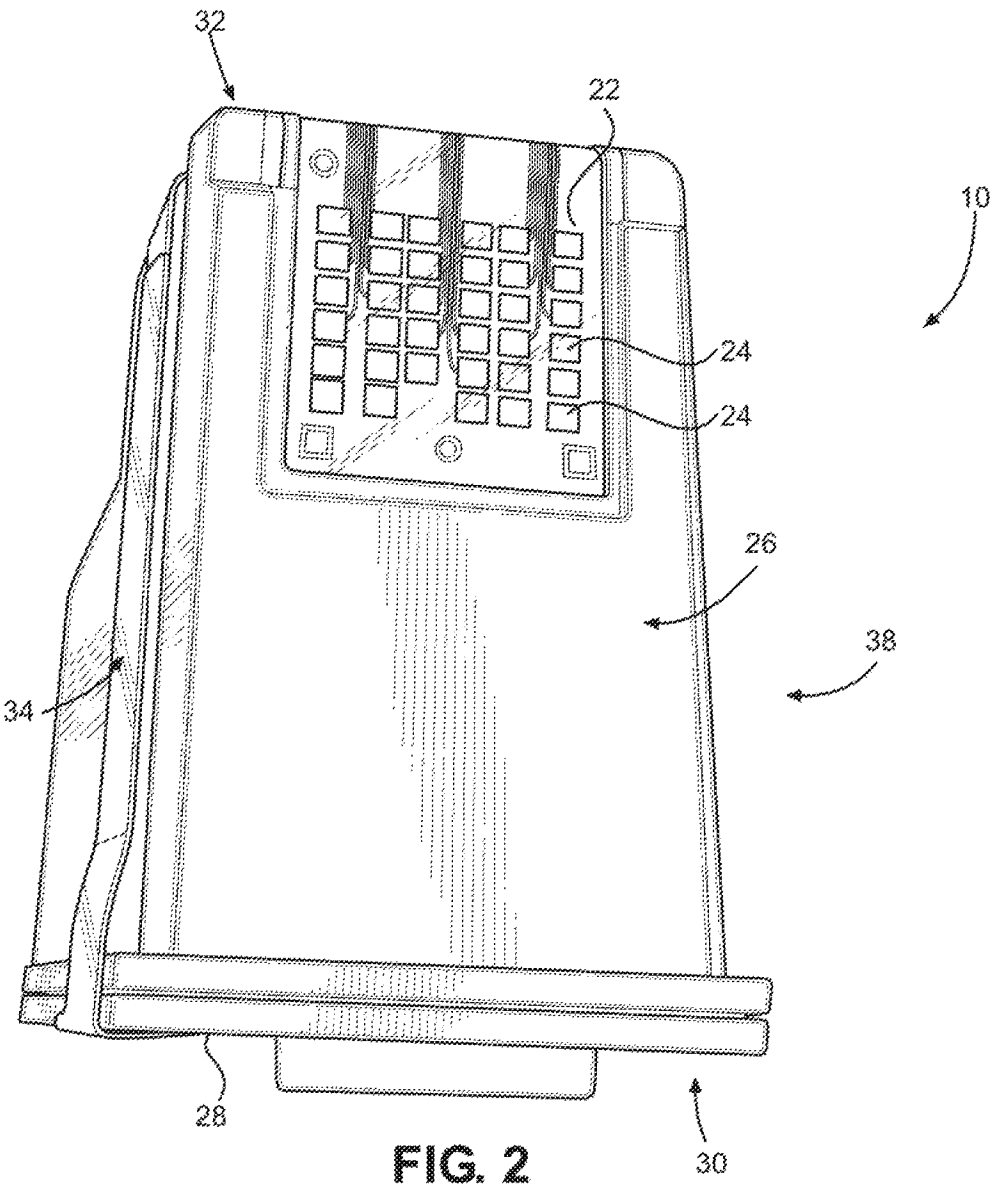
FIG. 2 is an end perspective view of the fluidic ejection cartridge of FIG. 1.
Figure 3:
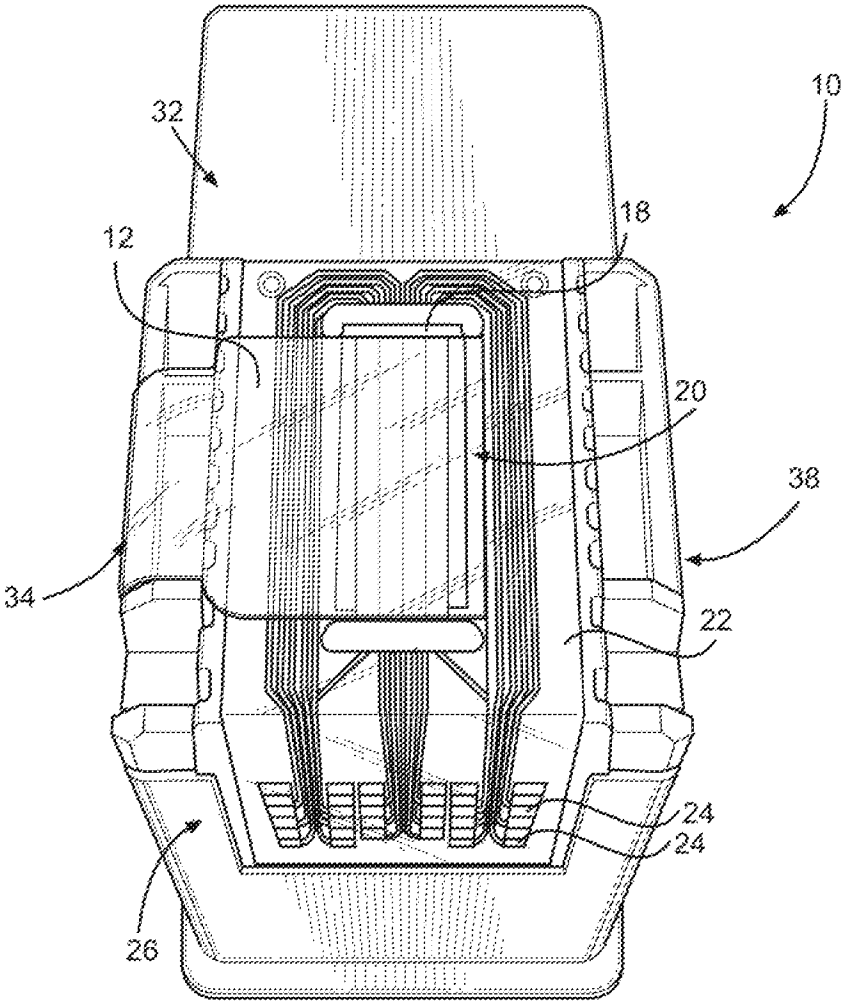
FIG. 3 is a top perspective view of an ejection head for the fluidic ejection cartridge of FIG. 1.

As shown in FIG. 2, a flexible circuit 22 is electrically connected to the ejection head 20 to control ejection of fluid from the fluidic cartridge 10 when the fluidic cartridge 10 is in use. The flexible circuit has electrical contacts 24 thereon that are disposed on a first end wall of the fluidic cartridge 10 for electrical connection to fluid ejection device, such as a printer, inhaler, E-cigarette, and the like. A cover 28 is attached to a first end 30 of the fluidic cartridge 10 opposite a second end 32 of the fluidic cartridge that contains the ejection head 20. The pull tape 14 and protective sealing tape 12 are removably attached to a first side wall of the fluidic cartridge (FIG. 1). The fluidic cartridge 10 also contains a second side wall 38 opposite the first side wall 34 and a second end wall 40 opposite the first end 30 thereof.

Before the cartridge 10 is installed and used in the fluid ejection device, the pull tape 14 is peeled away from the first side wall 34 of the fluidic cartridge 10 by grasping a tab on one end of the pull tape 14 and pulling the pull tape 14 away from the first side wall 34 of the fluidic cartridge 10. As the pull tape 14 is removed from the fluidic cartridge 10, the protective sealing tape 12, attached to the pull tape 14 in the overlapping area 16, is also removed from the fluidic cartridge 10 so that fluid can then be ejected from the ejection head 20.

Figure 4:
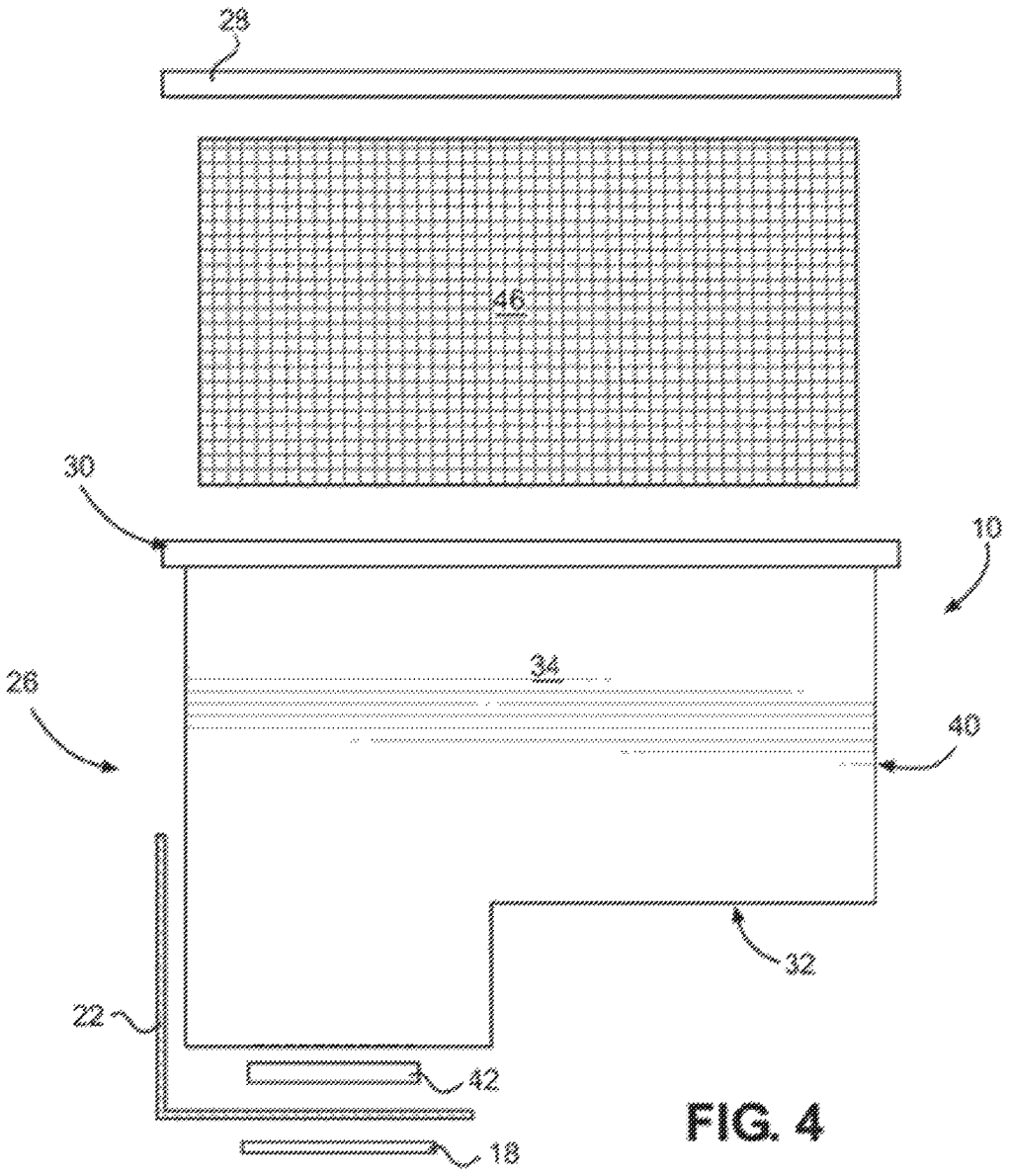
FIG. 4 is a schematic exploded view, not to scale, of the fluidic ejection cartridge of FIG. 1.

Further details of the fluidic cartridge 10 may be seen in an exploded view of the fluidic cartridge 10 illustrated schematically in FIG. 4. The ejection head 20 includes a semiconductor substrate 42 to which the flexible circuit 22 is electrically attached and the nozzle plate 18 attached to the semiconductor substrate 42 in a window (not shown) of the flexible circuit 22. In some embodiments, the fluidic cartridge 10 is filled with an open cell foam material 46 that holds fluid to be ejected from the ejection head 20.

Figure 5:
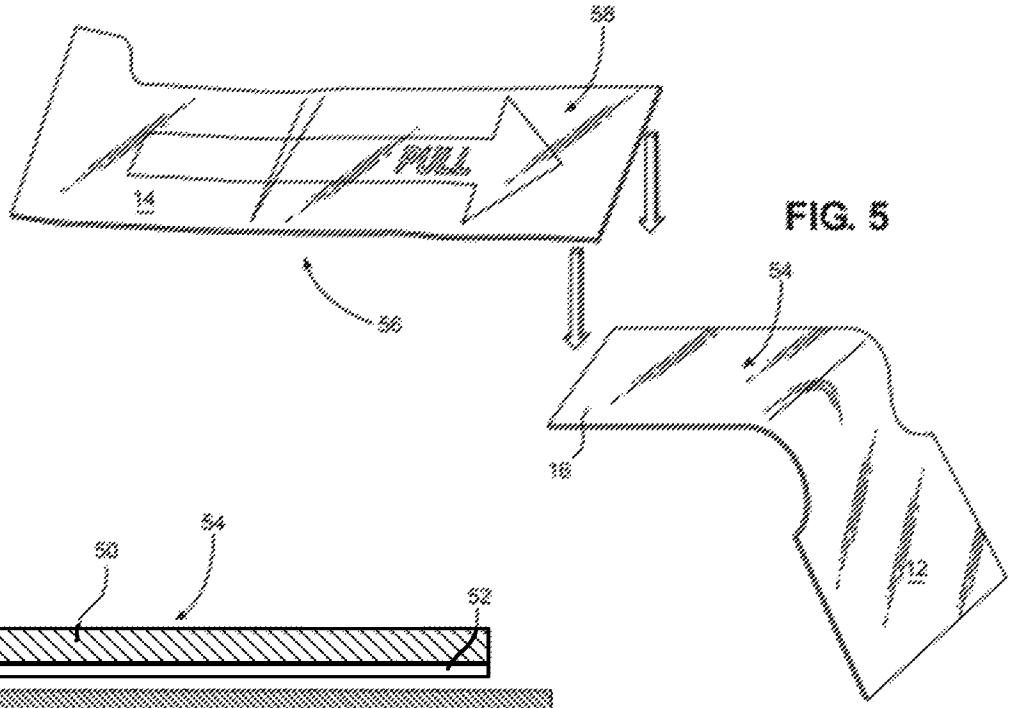
FIG. 5 are perspective view, not to scale, of a protective sealing tape and pull tape for protecting the ejection head of the fluidic ejection cartridge of FIG. 1.
Figure 6:
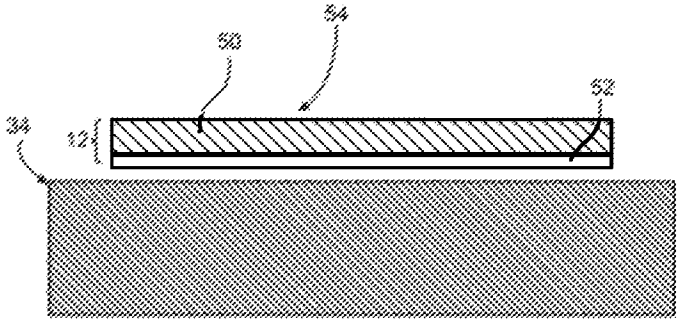
FIG. 6 is a cross-sectional view, not to scale, of the protective sealing tape of FIG. 5 for attaching to a side wall of the fluidic cartridge.

In embodiments described herein, the protective sealing tape 12 is used to cover and protect nozzle holes on the nozzle plate 18 as described above. The protective sealing tape 12 is shown in FIGS. 5 and 6 and is tape 12 having an overall thickness of from about 45 to about 150 microns. The protective sealing tape 12 has a base film layer of polyethylene terephthalate, polypropylene, polyethylene, polybutene, polybutadiene, polymethyl pentene, polyvinyl chloride, vinyl chloride copolymer, polybutylene terephthalate, polyurethane, ethylene-vinyl acetate copolymer, ionomer resin, ethylene-(meth)acrylic acid copolymer, ethylene-alkyl meth(acrylate) copolymer, polystyrene, polyimide, polyamide, or polycarbonate having a thickness of from about 20 to about 80 microns such as from about 25 to about 75 microns and an adhesive layer 52 on one side thereof having a thickness of from about 20 to about 70 microns. The adhesive layer 52 has a peel strength ranging from about 170 to about 350 Newton per meter (N/m) on a silicon wafer as determined using a 20-millimeter-wide sample at a peeling speed of 300 mm/min and at an angle of 90 degrees. It is important that adhesive layer 52 of the protective sealing tape 12 contain a low amount of impurities since it is in intimate contact with the nozzle plate 18 and could contaminate the nozzle holes in the nozzle plate thereby blocking the nozzle holes from functioning properly.

The pull tape 14 is attached in the overlap area 16 to a backside 54 of the protective sealing tape 12. The pull tape can be made of a wide variety of materials provided the adhesive use on an underside 56 of the pull tape 14 has a peel strength of about 2 times greater and desirably at least about 3 time greater than the peel strength of the protective sealing tape 12. In some embodiments, the pull tape 14 has a peel strength of greater than about 120 N/m, such as greater than about 140 N/m, and desirably greater than about 200 N/m. The pull tape 14 is also attached to the first side wall 34 of the cartridge 10 adjacent to the protective sealing tape 12.

It will be appreciated that the ejection head 20 with its semiconductor substrate 42 and nozzle plate 18 is a precisely manufactured device that is capable of high resolution fluid ejection. Accordingly, protection of the ejection head 20 is important for the proper operation of the fluid ejection device. As shown in FIG. 1, the protective sealing tape 12 is applied to the ejection head 20 and the first side wall 34 of the fluidic ejection cartridge 10 and the pull tape 14 is applied to the first side wall 34 of the fluidic ejection cartridge 10 adjacent an end of the protective sealing tape 12. Thus, the protective sealing tape 12 may be peeled from the ejection head 20 in a direction that is orthogonal to a longitudinal direction of the nozzle plate 18 and substrate 42. Such peeling direction is effective to reduce stresses that may occur to the ejection head 20 when the protective sealing tape 12 is peeled therefrom and reduces the likelihood that the nozzle plate 18 will delaminate from the substrate 42. Accordingly, it is desirable that the protective sealing tape 12 be peeled in the orthogonal direction rather that in a longitudinal direction with respect to the ejection head.

As shown in FIGS. 1 and 5 it is important that the pull tape 14 overlap the backside 54 of the protective sealing tape 12 to improve the removal of the protective sealing tape 12 from the cartridge 10. Also, since the protective sealing tape 12 has a lower peel strength than the pull tape 14, overlapping the protective sealing tape 12 on a backside 58 of the pull tape 14 may lead to separation of the protective sealing tape 12 from the pull tape 14 and thus result in incomplete removal of the protective sealing tape 12 from the ejection head 20.

The adhesive material used on the underside 56 of the pull tape 14 is not particularly critical to the disclosed embodiments. Accordingly, the pull tape adhesive may be a pressure sensitive adhesive selected from various radiation curable polymers such as epoxy, diolefin, urethane, polyimide, acrylic, silicone and vinyl ester polymers including a polymerization initiator. Examples of acrylic polymers which may be used include homopolymers or copolymers of an alkyl (meth)acrylate, and copolymers of (meth)acrylate and another copolymerizable monomer such as a hydroxyalkyl (meth)acrylate, glycidyl(meth)acrylate, (meth)acrylic acid, itaconic acid, maleic anhydride, (meth)acrylic amide, (meth) acrylic N-hydroxymethylamide, an alkylaminoalkyl(meth) acrylate, silicone adducted acrylate, vinyl acetate, styrene or acrylonitrile. In addition to the acrylic and epoxy adhesive materials, polyimide and silicone based materials may also be used as base materials for the pressure sensitive adhesive layer on the underside 56 of the pull tape 14.

It is also important that the adhesive layer 52 of the protective sealing tape 12 be resistant to organic solvents of the organic solvent-based fluid in the fluidic cartridge 10. Initial studies found that silicone-based adhesives were the most resistant to the very harsh solvents used in commercial and industrial ink. There are 2 types of silicone resins used to make silicone adhesives. The most common silicone resin uses a benzoyl peroxide (BPO) catalyst. These resins have excellent high temperature properties, tack and adhesion. Unfortunately, solvents can react with the crosslinking reaction which breaks down the adhesive. The other type of silicone resin is the platinum-cured silicone. The platinum-cured silicone resin is less common because it is more expensive and can be poisoned easily if not properly processed. However, the platinum-cured silicone resin is more resistant to solvent attack. It was observed that the platinum-cured silicone resin adhesive tapes were the only adhesive materials compatible with the solvent based systems. To further improve the cohesive properties of the adhesive, glass fibers were added to the resin.

A particularly suitable platinum-cured silicone adhesive comprises a glass-filled mixture of vinyl functional polydimethylsiloxane and silicone resin in toluene and xylene. A suitable platinum-cured silicone adhesive has an adhesion characteristic ranging from above about 4 g/cm to less than about 300 g/cm, and particularly in the range of from about 40 g/cm to about 250 g/cm and is does not dissolve in methylethyl ketone, ethanol or methanol.

Accordingly, it was found, quite surprisingly, that only the glass-filled platinum-cured silicone adhesive was effective for use for sealing cartridges 10 containing organic solvent-based fluids. Suitable protective sealing tapes 12 include the platinum-cured silicone based adhesive for contact and sealing of nozzle holes in the nozzle plate 18. In particular, the adhesive layer 52 is suitably a glass filled platinum-cured silicone adhesive layer 52. Such glass filled platinum-cured silicone adhesive materials have been found to be particularly resistant to organic solvent-based fluids thereby maintaining a peel strength for a prolonged period of time while being exposed to the organic solvent-based fluid in the cartridge 10. Conventional adhesives, such as acrylic adhesive, peroxide-catalyzed silicone adhesive, natural and synthetic rubber based adhesive, and hot melt adhesives fail to maintain suitable peel strength, and/or fail to remain in place on the nozzle plate despite relatively high initial peel strengths as shown by the following examples.

In order to demonstrate the advantages of the embodiments of the disclosure, the following non-limiting example is provided.

Example

In order to determine if a particular adhesive material was suitable for use on a fluidic cartridge containing an organic solvent-based fluid, a screening test was used to evaluate protective tapes containing different adhesive materials. The screening test included placing a sample tape on a semiconductor wafer that was coated with a hydrophobic epoxy nozzle plate material. A peel test tool was then used to determine the initial peel strength (TO) of the sample tape with respect to coated the wafer. Next the wafer with the sample tape attached was placed in a vessel containing an organic solvent for 3 days and the solvent was maintained at a temperature of 60° C.

After 3 days, the wafer was removed from the vessel and the solvent was rinsed from the wafer and tape with ethanol. The peel tool was used to determine the peel strength (T3) after 3 days in the solvent.

If the peel strength of the sample tape was sufficient to hold the sample tape on the wafer, then the sample tape was tested on an actual ejection head of a fluidic cartridge containing an organic solvent-based fluid. In the ejection head test, the sample tape was attached to the ejection head and the cartridge was filled in an organic solvent-based fluid. The cartridge was placed in an over at 60° C. for 8 weeks and any leakage of fluid from the ejection head was recorded. Drop and altitude testing was also conducted on the cartridge containing the sample tape. Results of the solvent test of various tapes containing different adhesive materials is shown in the following table.

TABLE 1

| Sample No. | Description | Adhesive Type | T0 day Peel Strength (N/m) | T3 days Peel strength (N/m) | Does the Sealing Tape Seal a fluidic cartridge |
|---|---|---|---|---|---|
| 1 | Acrylic 1 | Acrylic | 131-210 | Fell off | No |
| 2 | Acrylic 2 | Acrylic | 8-18 | Fell off | No |
| 3 | Acrylic 2 | Acrylic | 420-683 | Fell off | No. |
| 4 | Silicone 1 | Silicone | 56-175 | 2.3-7 | No |
| 5 | Silicone 2 | Non-glass filled Peroxide- cured Silicone | 297 | 26 | No |
| 6 | Silicone 3 | Silicone | 427-595 | 11 or Messy, pulled off backing film or fell off | No |
| 7 | Hot melt 1 | Ethylene acrylic acid copolymer | 88 | Fell off | No |
| 8 | Hot melt 2 | Polyester thermoplastic | 0 | Fell off | No |
| 9 | Hot melt 3 | Nitrile Phenolic | 82.5 | Fell off | No |
| 10 | Rubber 1 | Synthetic | 560-1366 | Fell off | No |
| 11 | Rubber 2 | Rubber | 237-876 | Fell off | No |
| 12 | Rubber 3 | Acrylic/rubber hybrid | 508 | Fell off | No |
| 13 | Silicone 4 | Glass-filled Platinum-cured | 263 | 35 | Yes |

As shown by the above data, acrylic adhesive samples 1 and 3, silicone adhesive samples 5, 6 and 13, and rubber samples 10, 11 and 12 all had relatively high initial peal strengths (TO). Only samples 4, 5, 6 and 13 had peel strengths (T3) after three days that could be measured. Surprisingly, despite the lower initial peel strength (TO) of sample 13 compared to sample 6, only the platinum-cured silicone adhesive material of sample 13 continued to seal the fluidic cartridge in the cartridge test. Even more surprising was the fact that sample 5 containing a peroxide-cured silicone adhesive similar to the adhesive of sample 13 did not pass the cartridge test.

Organic solvents are a very harsh environment for organic materials, especially adhesives. The platinum-cured silicone adhesives were found to withstand the harsh environment better than acrylics, rubbers, synthetic rubbers, acrylic/rubber hybrids or hot melt adhesives. As the data shows however, not all silicone adhesives can pass the aggressive testing with a solvent. Only the platinum-cured silicone adhesive tape was found to be suitable for use on fluidic cartridges containing organic solvent-based fluids.

As noted above, fluidic ejection cartridges 10 may be used in variety of applications, including for instance inkjet printing applications. Fluidic ejection cartridges may also be used for other nonprinting applications as well, particularly for applications calling for the precise metering of small amounts of liquid materials and vaporous materials. For example, the ejection cartridges described herein may be used in the preparation of cosmetics, paints, or lubricants and in the ejection of liquids and vapors for medical treatment.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A fluidic ejection cartridge and protective tape therefor, comprising:

a cartridge body for an organic solvent-based fluid having a cover closing a first end thereof, an ejection head on a second end thereof opposite the first end, and side walls attached to the first and second ends between the first and second ends, wherein the side walls comprise a first side wall, a second side wall opposite the first side wall, a first end wall attached to the first and second side walls, and a second end wall opposite the first end wall attached to the first and second side walls; and a removable tape attached to a nozzle plate of the ejection head and to a portion of the first side wall, wherein the removable tape comprises a polymeric backing film and a glass-filled, platinum-cured silicone adhesive.

2. The fluidic ejection cartridge of claim 1, wherein the removable tape has a peel strength on a dry silicon wafer ranging from about 175 to about 350 N/m.

3. The fluidic ejection cartridge of claim 1, wherein the removable tape has a peel strength on a silicon wafer immersed in an organic solvent for three days ranging from about 17 to about 70 N/m.

4. The fluidic ejection cartridge of claim 1, wherein the removable tape is disposed on the nozzle plate so as to prevent the organic solvent-based fluid from leaking out of the ejection head.

5. The fluidic ejection cartridge of claim 1, wherein the glass-filled, platinum-cured silicone adhesive has a thickness on the polymeric backing film ranging from about 25 to about 75 microns.

6. The fluidic ejection cartridge of claim 1, wherein the glass-filled, platinum-cured silicone adhesive comprises a glass-filled, platinum cured silicone rubber adhesive material applied to the polymeric backing film wherein the polymer of backing film is selected from the group consisting of polyethylene terephthalate, polypropylene, polyamide, and polyimide.

7. A fluidic ejection device comprising the fluidic ejection cartridge of claim 1.

8. A method for improving the sealing of a nozzle plate of an ejection head attached to a fluidic ejection cartridge containing an organic solvent-based fluid, the method comprising:

providing a cartridge body for the organic solvent-based fluid having a cover closing a first end thereof, the ejection head on a second end thereof opposite the first end, and side walls attached to the first and second ends between the first and second ends, wherein the side walls comprise a first side wall, a second side wall opposite the first side wall, a first end wall attached to the first and second side walls, and a second end wall opposite the first end wall attached to the first and second side walls; and attaching a removable tape to the nozzle plate of the ejection head and to a portion of the first side wall, wherein the removable tape comprises a polymeric backing film and a glass-filled, platinum-cured silicone adhesive.

9. The method of claim 8, wherein the removable tape has a peel strength on a dry silicon wafer ranging from about 175 to about 350 N/m.

10. The method of claim 8, wherein the removable tape has a peel strength on a silicon wafer immersed in an organic solvent for three days ranging from about 17 to about 70 N/m.

11. The method of claim 8, wherein the removable tape covers the nozzle plate on the ejection head and prevents the organic solvent-based fluid from leaking out of the ejection head.

12. The method of claim 8, wherein the glass-filled, platinum-cured silicone adhesive has a thickness on the polymeric backing film ranging from about 25 to about 75 microns.

13. The method of claim 8, wherein the glass-filled, platinum-cured silicone adhesive comprises a glass-filled silicone rubber adhesive material applied to the polymeric backing film wherein the polymer of backing film is selected from the group consisting of polyethylene terephthalate, polypropylene, polyamide, and polyimide.

* * * * *